US011181037B2

(12) United States Patent
Kurata

(10) Patent No.: US 11,181,037 B2
(45) Date of Patent: Nov. 23, 2021

(54) TWO-STROKE ENGINE

(71) Applicant: HONDA MOTOR CO., LTD., Tokyo (JP)

(72) Inventor: Mashu Kurata, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 313 days.

(21) Appl. No.: 16/478,188

(22) PCT Filed: Dec. 12, 2017

(86) PCT No.: PCT/JP2017/044565
§ 371 (c)(1),
(2) Date: Jul. 16, 2019

(87) PCT Pub. No.: WO2018/135191
PCT Pub. Date: Jul. 26, 2018

(65) Prior Publication Data

US 2021/0285362 A1 Sep. 16, 2021

(30) Foreign Application Priority Data

Jan. 18, 2017 (JP) ..... JP2017-006876

(51) Int. Cl.
*F02B 25/04* (2006.01)
*F02B 75/02* (2006.01)
(Continued)

(52) U.S. Cl.
CPC ..... *F02B 25/04* (2013.01); *F02B 25/20* (2013.01); *F02B 33/04* (2013.01); *F02B 75/02* (2013.01); *F02B 2075/025* (2013.01)

(58) Field of Classification Search
CPC ..... F02B 25/04; F02B 25/20; F02B 33/04; F02B 75/02; F02B 2075/025; F02D 41/30;
(Continued)

(56) References Cited

U.S. PATENT DOCUMENTS 5,690,063 A * 11/1997 Motoyama ..... F02D 37/02 123/73 A
5,762,040 A * 6/1998 Taipale ..... F02M 69/465 123/299
(Continued)

FOREIGN PATENT DOCUMENTS

JP 2002-332847 11/2002
JP 2012-154189 A 8/2012
(Continued)

OTHER PUBLICATIONS

International Search Report, dated Jan. 23, 2018 (Jan. 23, 2018), 1 page.
(Continued)

*Primary Examiner* — Grant Moubry
(74) *Attorney, Agent, or Firm* — Rankin, Hill & Clark LLP

(57) ABSTRACT

A two-stroke engine includes: a scavenging port communicating with a crank chamber and a side portion of a cylinder, and switchably brought into communication with or shut off from the cylinder by a piston; and multiple fuel injection valves for injecting fuel into the scavenging port. Since the fuel injection valves inject fuel into the scavenging port, there is no need to apply a high pressure injection system. By causing the start of fuel injection to be delayed from a timing at which the scavenging port is opened, fresh air is sent into the cylinder at an early stage of scavenging, and air-fuel mixture is sent into the cylinder at a late stage of scavenging.
(Continued)

Thereby, even in a long-stroke engine, stratified scavenging is performed to suppress blow-by of air-fuel mixture.

9 Claims, 4 Drawing Sheets

(51) Int. Cl.

| | |
|---|---|
| ***F02D 41/30*** | (2006.01) |
| ***F02D 41/40*** | (2006.01) |
| ***F02B 33/04*** | (2006.01) |
| ***F02B 25/20*** | (2006.01) |

(58) Field of Classification Search
CPC .. F02D 41/3005; F02D 41/3094; F02D 41/34; F02D 41/40
See application file for complete search history.

(56) References Cited

U.S. PATENT DOCUMENTS

2002/0148436 A1* 10/2002 Kawagoe ..... F02B 5/02 123/305
2013/0133624 A1* 5/2013 Hirose ..... F02D 19/10 123/478

FOREIGN PATENT DOCUMENTS

| | | |
|---|---|---|
| JP | 2012-522179 | 9/2012 |
| JP | 2014-145289 | 8/2014 |
| JP | 2015-169195 | 9/2015 |

OTHER PUBLICATIONS

Japanese Office Action with English translation dated Oct. 29, 2019, 6 pages.

* cited by examiner

A
33
43B
43
5
6
32
34
E
29
43A
30
52
1
4
31
28
23
23A
21
18A
51
18
19
3
16
56
56
57B
57B
III
2
42
III
60
22
41
57A
26
67
55
67
2B
47
8C
46
8D
8E
8
8B
8B
8A
8A
2A
45
11
2C
12

TWO-STROKE ENGINE

TECHNICAL FIELD

The present invention relates to a two-stroke engine.

BACKGROUND ART

In two-stroke engines, the amount of hydrocarbons released to the air tends to be large due to blow-by of air-fuel mixture, and a negative impact thereof on the environment is pointed out. As a method for reducing the total hydrocarbons (THC) that is released, stratified scavenging is known, in which air is sent into the cylinder at an early stage of scavenging, and air-fuel mixture is sent into the cylinder at a late stage of scavenging, so that a layer of air-fuel mixture is formed under a layer of air to thereby suppress the release of air-fuel mixture due to blow-by (for instance, Patent Documents 1 and 2).

As another method for reducing THC, in-cylinder injection is known, in which after the gas exchange by scavenging is finished (after the exhaust port is closed), fuel is directly injected into the cylinder before the start of combustion, to thereby suppress the release of unburned fuel (for instance, Patent Document 3).

PRIOR ART DOCUMENT(S)

Patent Document(s)

Patent Document 1: JP2002-332847A
Patent Document 2: JP2015-169195A
Patent Document 3: JP2012-522179A

SUMMARY OF THE INVENTION

Task to be Accomplished by the Invention

However, in the stratified scavenging, it is necessary that the scavenging port is closed by the piston skirt when the piston is positioned near the top dead center. Therefore, in a case where a long piston stroke is adopted to reduce cooling loss or any other reasons, it is necessary to form an air passage as in Patent Documents 1 and 2 or to increase the length of the piston skirt to such an extent that the scavenging port is closed when the piston is near the top dead center. However, the increase in the length of the piston skirt may cause problems such as contact of the piston skirt to other members when the piston is near the bottom dead center or an increase in the piston weight.

On the other hand, in the in-cylinder injection, it is necessary to inject fuel into the cylinder pressurized in the upward stroke in a short time before the start of combustion, and therefore, a high pressure injection system is needed, which increases the cost.

In view of the foregoing background, an object of the present invention is to provide a two-stroke engine which does not require use of a high pressure injection system and can suppress blow-by of air-fuel mixture by stratified scavenging even when applied to a long-stroke engine.

Means to Accomplish the Task

To achieve the above object, a two-stroke engine (E) according to one embodiment of the present invention includes: a cylinder wall (19, 3, 4) defining a cylinder (22); a piston (23) reciprocably provided in the cylinder and defining a combustion chamber (29) in the cylinder; a crankcase (2) defining a crank chamber (2A) communicating with a lower end of the cylinder; an intake passage (2G) communicating with the crank chamber; a one-way valve (54) for opening and closing the intake passage; a scavenging port (55) communicating with the crank chamber and a side portion of the cylinder, and switchably brought into communication with or shut off from the cylinder by the piston; an exhaust port (31) communicating with a top part of the combustion chamber; an exhaust valve (32) for opening and closing the exhaust port; multiple fuel injection valves (68) for injecting fuel into the scavenging port; and a control unit (70) configured to drive-control the fuel injection valves so as to start fuel injection at a timing later than a timing at which the scavenging port is opened by the piston (later than a first crank angle A1), and terminate the fuel injection before the scavenging port is closed by the piston (before a second crank angle A2).

According to this configuration, because the fuel injection valves inject fuel into the scavenging port, there is no need to apply a high pressure injection system. In addition, because the control unit delays the start of fuel injection from the timing at which the scavenging port is opened, it is possible to send fresh air into the cylinder at an early stage of scavenging and to send air-fuel mixture into the cylinder at a late stage of scavenging. Thereby, even when applied to a long-stroke engine, stratified scavenging can be performed to suppress blow-by of air-fuel mixture. Further, because multiple fuel injection valves are provided, it is possible to inject a predetermined amount of fuel in a short time by using compact, general-purpose and low-cost fuel injection valves.

In the above configuration, preferably, the fuel injection valves (68) are provided so as to inject fuel toward an opening (56) of the scavenging port (55) on a side of the cylinder (22).

According to this configuration, the period of time from when the fuel is injected to when the fuel flows into the combustion chamber is reduced, and therefore, it is possible to supply an appropriate amount of fuel to the combustion chamber at an appropriate timing. This improves the stratified scavenging effect.

In the above configuration, preferably, the control unit is configured to drive all of the fuel injection valves in middle and high load operations, and stop driving at least one fuel injection valve (68B) in a low load operation.

According to this configuration, in the low load operation, the amount of injection by the driven fuel injection valve(s) is increased, whereby an error in the amount of fuel injection can be reduced.

In the above configuration, preferably, the control unit (70) is configured to drive-control the fuel injection valves (68) such that fuel injection is completed at a timing (at a third crank angle A3) earlier by a prescribed time than a timing (A2) at which the scavenging port is closed by the piston.

According to this configuration, adhesion of the injected fuel onto a side surface of the piston and injection of fuel to a lower part of the cylinder communicating with the crank chamber due to passing of the piston can be suppressed.

In the above configuration, preferably, the control unit (70) is configured to advance a start of the fuel injection by the fuel injection valves (68) with an increase in an amount of fuel to be injected.

According to this configuration, a period in which the injected fuel flows into the combustion chamber comes to be in a late stage of scavenging, and therefore, blow-by of air-fuel mixture is suppressed.

Effect of the Invention

According to the foregoing configuration, it is possible to provide a two-stroke engine which does not require use of a high pressure injection system and can suppress blow-by by stratified scavenging even when applied to a long-stroke engine.

MODES FOR CARRYING OUT THE INVENTION

In the following, a detailed description will be made of an embodiment of the present invention with reference to the drawings, in which the present invention is applied to a single cylinder, two-stroke engine (hereinafter referred to as an engine E). The engine E in this embodiment is configured as a uniflow, pre-mixture compression-ignition two-stroke engine, in which the flow of scavenging gas and exhaust gas is guided along a relatively straight path. The engine E uses light oil or gasoline as fuel.

Figure 1:
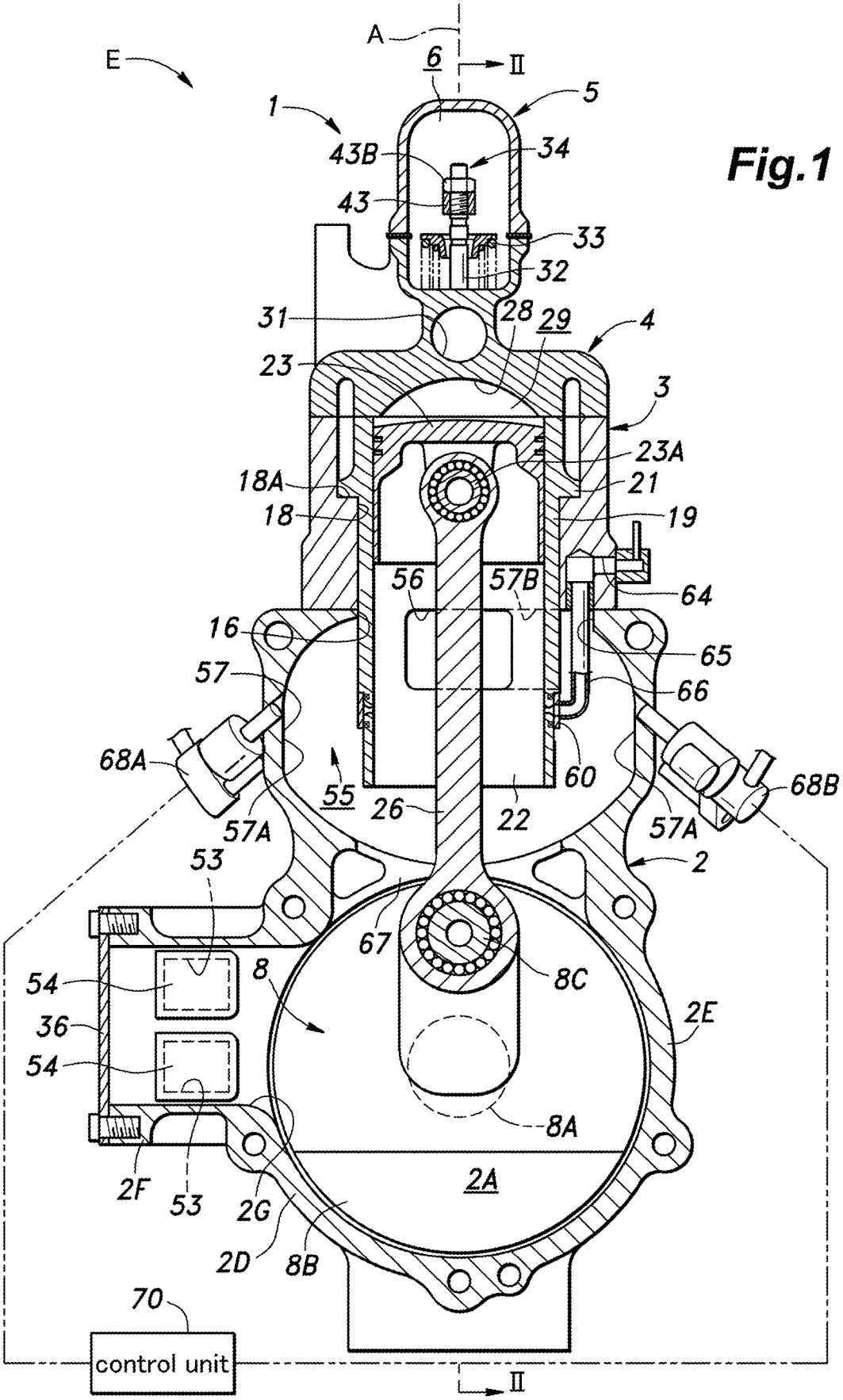
FIG. 1 is a vertical sectional view of an engine according to an embodiment of the present invention.
Figure 2:
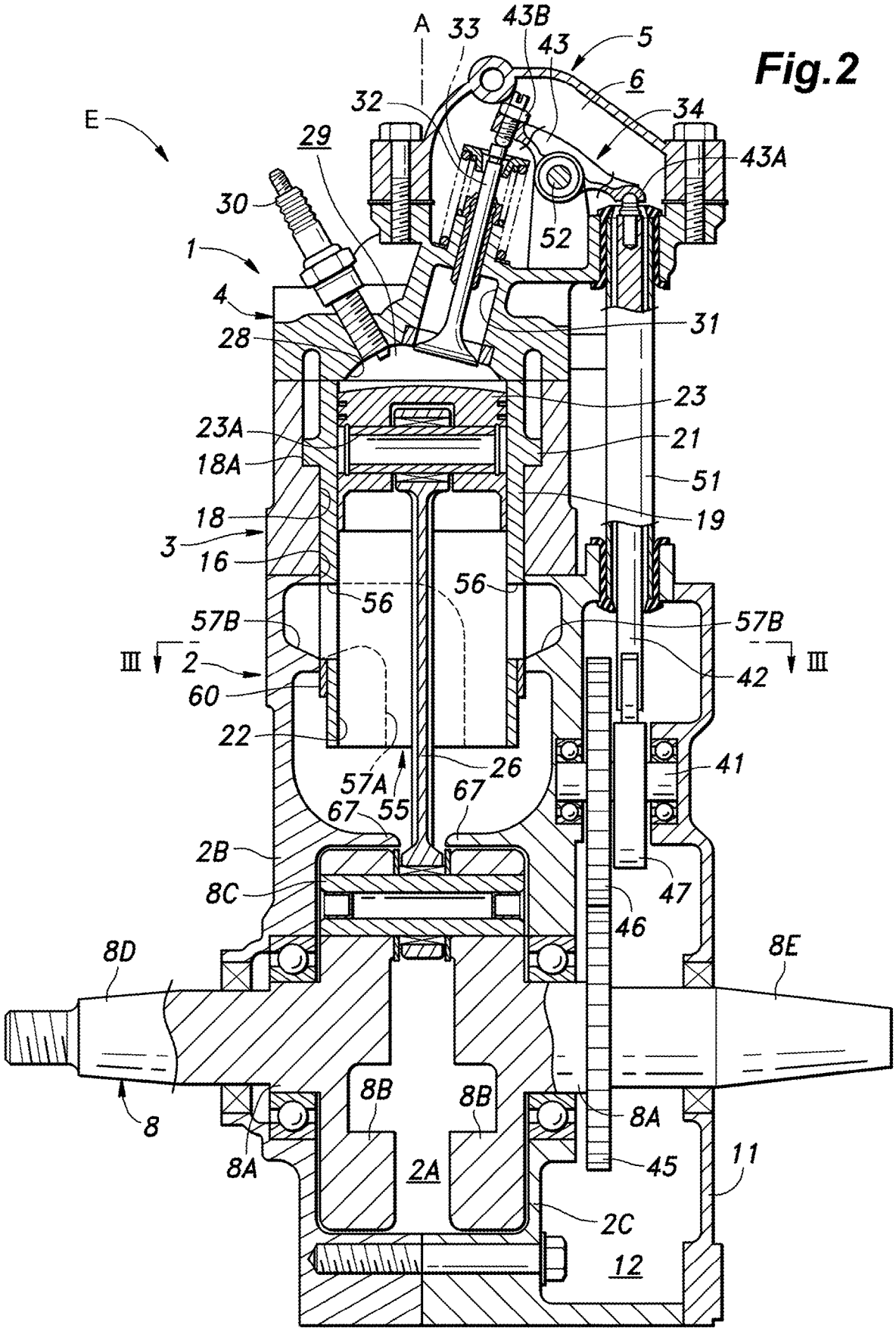
FIG. 2 is a sectional view taken along line II-II in FIG. 1.

As shown in FIGS. 1 and 2, an engine main body 1 of the engine E includes a crankcase 2 defining a crank chamber 2A therein, a cylinder block 3 attached to an upper part of the crankcase 2, a cylinder head 4 attached to an upper part of the cylinder block 3, and a head cover 5 attached to an upper part of the cylinder head 4 and defining an upper valve chamber 6 between itself and the cylinder head 4.

As shown in FIG. 2, the crankcase 2 is constituted of a pair of crankcase halves which are parted laterally by a vertically extending plane (a plane passing the cylinder axis A). The left and right crankcase halves are fastened to each other by bolts and define the crank chamber 2A therebetween. The left and right side walls 2B, 2C of the crankcase 2 rotatably support a crankshaft 8 via bearings.

The crankshaft 8 includes a pair of journals 8A supported by the side walls 2B, 2C of the crankcase 2, a pair of crank webs 8B provided between the journals 8A, and a crankpin 8C supported by the crank webs 8B at a position radially offset from the journals 8A.

An end plate 11 is secured on an outer surface side of the right side wall 2C. The end plate 11 is secured to the outer surface of the right side wall 2C at a periphery thereof and defines a lower valve chamber 12 between itself and the right side wall 2C. The left end portion 8D of the crankshaft 8 passes through the left side wall 2B of the crankcase 2 and extends out to the left. The right end portion 8E of the crankshaft 8 passes through the right side wall 2C of the crankcase 2 and the end plate 11 and extends out to the right. A seal member is provided at each of the part where the left end portion 8D of the crankshaft 8 passes through the left side wall 2B and the part where the right end portion 8E of the same passes through the end plate 11 to ensure an air tight seal of the crank chamber 2A.

The upper part of the crankcase 2 has a first sleeve reception bore 16 formed therein, where the first sleeve reception bore 16 extends vertically, has an upper end that opens out at the upper end surface of the crankcase 2 and a lower end that opens out to the crank chamber 2A, and has a circular cross section.

The cylinder block 3 extends vertically and is fastened to the upper end surface of the crankcase 2 at the lower end surface thereof. The cylinder block 3 is provided with a second sleeve reception bore 18 that extends vertically therethrough from the upper end surface to the lower end surface. The second sleeve reception bore 18 is a stepped bore having a circular cross section, where an upper part of the second sleeve reception bore 18 is given a larger diameter than a lower part such that an upward-facing annular shoulder surface 18A is defined at the interface between the upper part and the lower part. The lower end opening of the second sleeve reception bore 18 is aligned coaxially with the upper end opening of the first sleeve reception bore 16 of the cylinder block 3 and is connected with the same. The first sleeve reception bore 16 and the lower part of the second sleeve reception bore 18 have the same inner diameter so as to form a continuous bore.

Press-fitted into the first and second sleeve reception bores 16, 18 is a cylinder sleeve 19 having a cylindrical shape. The cylinder sleeve 19 is provided on its outer circumference with an annular projection 21 that projects radially outward. The projection 21 abuts the shoulder surface 18A to determine the position of the cylinder sleeve 19 relative to the first and second sleeve reception bores 16, 18. The lower end of the cylinder sleeve 19 protrudes downward from the lower end opening of the first sleeve reception bore 16 and makes a protruding end inside the crank chamber 2A. The upper end of the cylinder sleeve 19 is positioned so as to be flush with the upper end surface of the cylinder block 3 and abuts the lower end surface of the cylinder head 4 joined to the cylinder block 3. Thereby, the cylinder sleeve 19 is interposed between the shoulder surface 18A and the lower surface of the cylinder head 4, and the position thereof in the direction of the cylinder axis A is determined. The inner bore of the cylinder sleeve 19 forms a cylinder 22. Namely, the cylinder block 3, the cylinder sleeve 19, and the cylinder head 4 constitute a cylinder wall defining the cylinder 22.

The cylinder 22 receives a piston 23 such that the piston 23 can reciprocate therein. The piston 23 has a piston pin 23A extending in parallel with the crankshaft 8. The piston pin 23A pivotably supports the small end of a connecting rod 26 via a bearing. The large end of the connecting rod 26 is pivotably supported by the crankpin 8C via a bearing. As the piston 23 and the crankshaft 8 are connected by the connecting rod 26, the reciprocating movement of the piston 23 is converted to the rotational movement of the crankshaft 8.

As shown in FIGS. 1 and 2, a hemispherical combustion chamber recess 28 is formed at a part of the lower end surface of the cylinder head 4 corresponding to the cylinder sleeve 19. In the cylinder 22, a combustion chamber 29 is defined between the combustion chamber recess 28 and the top surface of the piston 23.

The cylinder head 4 is provided with a spark plug 30 so as to face the combustion chamber 29. Further, the cylinder head 4 is provided with an exhaust port 31 opening out to the combustion chamber recess 28 to be in communication with the top end of the combustion chamber 29 and an exhaust valve 32 consisting of a poppet valve to selectively close and open the exhaust port 31. The exhaust valve 32 has a stem end disposed in the upper valve chamber 6 and is urged by a valve spring 33 in the closing direction. The exhaust valve 32 is opened and closed by a valve actuating mechanism 34 in synchronization with the rotation of the crankshaft 8.

As shown in FIG. 2, the valve actuating mechanism 34 includes a camshaft 41 that rotates in response to the rotation of the crankshaft 8, a pushrod 42 driven to advance and retreat by the camshaft 41, and a rocker arm 43 driven by the pushrod 42 to push the exhaust valve 32 in the opening direction. The camshaft 41 is disposed in the lower valve chamber 12 in parallel with the crankshaft 8. The camshaft 41 has one end rotatably supported by the right side wall 2C of the crankcase 2 and the other end rotatably supported by the end plate 11. The crankshaft 8 has a crank gear 45 at a part located in the lower valve chamber 12, and the camshaft 41 has a cam gear 46 engaging the crank gear 45. The gear ratio between the crank gear 45 and the cam gear 46 is 1:1.

The camshaft 41 is provided with a cam 47 consisting of a plate cam.

The pushrod 42 is received in a tubular rod case 51 having open ends so as to be capable of advancing and retreating. The rod case 51 extends vertically, and the lower end thereof is joined to the right side wall 2C of the crankcase 2 and in communication with the lower valve chamber 12 while the upper end thereof is joined to the cylinder block 3 and in communication with the upper valve chamber 6. The pushrod 42 is in contact with the cam 47 of the camshaft 41 at its lower end, and advances and retreats in response to the rotation of the camshaft 41. It is also possible to provide the lower end of the pushrod 42 with a roller, so that the pushrod 42 is in rolling contact with the cam 47 via the roller.

The rocker arm 43 is pivotably supported by a rocker shaft 52 supported by the cylinder head 4. The rocker shaft 52 extends in a direction perpendicular to the cylinder axis A and the axis of the crankshaft 8. The rocker arm 43 has at one end thereof a receiving part 43A in contact with the upper end of the pushrod 42 and has at the other end thereof a screw adjuster 43B in contact with the stem end of the exhaust valve 32.

With the valve actuating mechanism 34 having the foregoing structure, each time the crankshaft 8 makes one revolution, the exhaust valve 32 is opened once at a predetermined timing.

As shown in FIG. 1, the front side wall 2D of the crankcase 2 is provided with a protruding portion 2F that protrudes forward. The interior of the protruding portion 2F defines an intake passage 2G extending in a fore and aft direction and having a rear end connected with the crank chamber 2A and an open front end. The front end of the intake passage 2G is closed by a lid 36 fastened to the front end of the protruding portion 2F. The left wall portion of the protruding portion 2F is provided with intake ports 53, which are through-holes connecting the inside and the outside of the protruding portion 2F. An outer end of each intake port 53 is connected with an intake device having an air cleaner, etc. not shown in the drawings. Each intake port 53 is provided with a reed valve 54 serving as a one-way valve that permits the flow of fluid from the intake port 53 toward the crank chamber 2A while prohibiting the flow of fluid from the crank chamber 2A toward the intake port 53. The reed valve 54 is normally closed, and opens when the piston 23 moves upward and the internal pressure in the crank chamber 2A thereby drops.

The crankcase 2 and the cylinder sleeve 19 are provided with multiple scavenging ports 55 that connect the crank chamber 2A with an interior of the cylinder sleeve 19 (a side portion of the cylinder 22). Each scavenging port 55 includes a scavenging orifice 56 formed in the cylinder sleeve 19 and a passage portion 57 extending from the scavenging orifice 56 to the crank chamber 2A. The passage portion 57 is defined in an upper part of the crankcase 2 around the first sleeve reception bore 16. In the present embodiment, each scavenging port 55 has one scavenging orifice 56 and one passage portion 57. In another embodiment, each scavenging port 55 may have two scavenging orifices 56 and one passage portion 57. The scavenging orifices 56 are formed in a part of the cylinder sleeve 19 inside the first sleeve reception bore 16 so as to extend through the cylinder sleeve 19 in the radial direction. The vertical dimension of the scavenging orifices 56 is selected to be smaller than the vertical dimension of the outer circumferential surface of the piston 23.

The scavenging orifices 56 (scavenging ports 55) are opened and closed by the reciprocating movement of the piston 23. Specifically, when the piston 23 is at a position corresponding to the scavenging orifices 56, the scavenging ports 55 are closed by the outer circumference of the piston 23, when the lower edge of the piston 23 is located higher than the lower edge of the scavenging orifices 56 (on the side of the top dead center), the scavenging ports 55 are opened so as to be in communication with the part of the cylinder 22 below the piston 23, and when the upper edge (top surface) of the piston 23 is located lower than the upper edge of the scavenging orifices 56 (on the side of the bottom dead center), the scavenging ports 55 are opened so as to be in communication with the part of the cylinder 22 above the piston 23 (combustion chamber 29). Thus, the scavenging ports 55 are switchably brought into communication with or shut off from the cylinder 22 by the piston 23.

Figure 3:
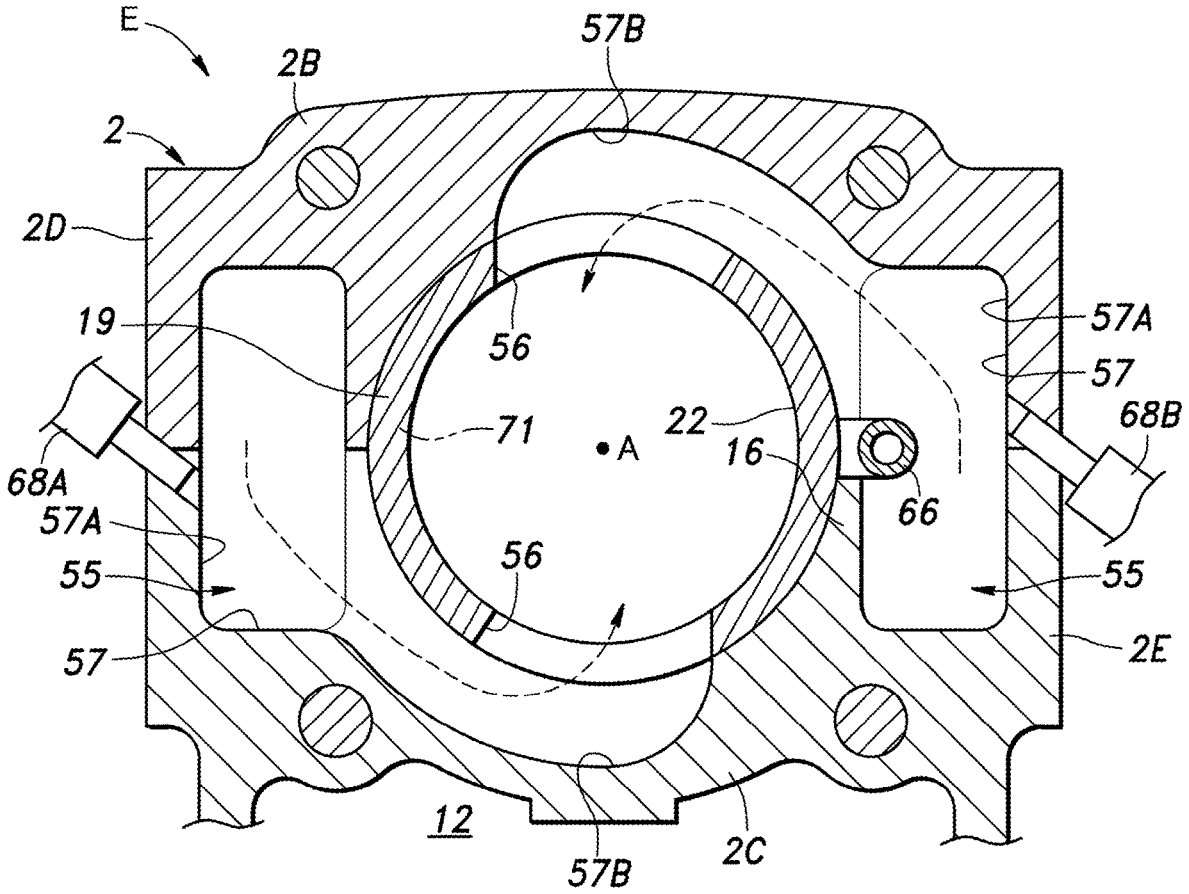
FIG. 3 is a sectional view taken along line in FIG. 2.

As shown in FIG. 1 to FIG. 3, in the present embodiment, the engine E has a pair of scavenging ports 55. In another embodiment, the engine E may have three or more scavenging ports 55. The pair of scavenging ports 55 and the scavenging orifices 56 have a rotationally symmetric shape about the cylinder axis A and are disposed at 180 degrees rotationally symmetric positons.

The upstream portion 57A of each scavenging port 55 extends upward from a lower end connected with the crank chamber 2A in parallel with the cylinder axis A on a radially outer side of the cylinder sleeve 19. The upper end of the upstream portion 57A is positioned to be higher than the upper edge of the scavenging orifices 56.

As shown in FIG. 3, the downstream portion 57B of each scavenging port 55 extends from an upper portion of the upstream portion 57A to the scavenging orifices 56 in the circumferential direction on the radially outer side of the cylinder sleeve 19. As viewed from above along the cylinder axis A, the downstream portion 57B extends counterclockwise around the cylinder axis A from the upstream side to the downstream side. The downstream end of the downstream portion 57B is the scavenging orifices 56 that open to the cylinder 22.

As shown in FIG. 2, the downstream portion 57B is preferably configured to slope downward from the upstream side to the downstream side in the circumferential direction around the cylinder axis A. Further, the downstream portion 57B is preferably configured to slope downward from the upstream side (radially outer side) to the downstream side (radially inner side) in the radial direction with the cylinder axis A being the center. The downstream portion 57B functions as a guide means that gives a downward velocity component to the gas flow entering the cylinder 22 from the scavenging port 55.

As shown in FIG. 1, an annular oil passage forming member 60 is attached to the outer circumference of the lower end part of the cylinder sleeve 19 projecting into the crank chamber 2A. The inner circumference of the oil passage forming member 60 is in surface contact with the outer circumference of the cylinder sleeve 19 in the circumferential direction. The part of the outer circumference of the cylinder sleeve 19 facing the inner circumference of the oil passage forming member 60 is formed with an annular groove that extends annularly in the circumferential direction (reference number is omitted). The annular groove is covered by the oil passage forming member 60 to define an annular channel. The oil passage forming member 60 is provided with an oil inlet hole (reference number is omitted) radially extending therethrough and in communication with the annular groove. The cylinder sleeve 19 is provided with an oil supply hole (reference number is omitted) radially extending therethrough and in communication with the annular groove. Multiple oil supply holes are formed in the circumferential direction of the cylinder sleeve 19.

The cylinder block 3 has a first oil passage 64 formed therein. The first oil passage 64 has one end that opens out at the side surface of the cylinder block 3 and the other end that opens out at the lower end surface of the cylinder block 3. The crankcase 2 is formed with a passage 65 extending from the scavenging port 55 to a part of the lower end surface of the cylinder block 3 at which the first oil passage 64 opens out. Connected to the open end of the first oil passage 64 that opens out at the lower end surface of the cylinder block 3 is one end of a second oil passage tube 66 that defines a second oil passage. The second oil passage tube 66 extends through the passage 65 into the scavenging port 55, and the other end thereof is connected to the oil inlet hole of the oil passage forming member 60. Thereby, the oil press-fed by the oil pump not shown in the drawings passes through the first oil passage 64, the second oil passage tube 66, the oil inlet hole, the annular groove and the oil supply holes in order, and is supplied to the inner wall of the cylinder sleeve 19.

As shown in FIG. 2, on the inner surfaces of the left and right side walls 2B, 2C of the crankcase 2 are provided respective flange portions 67 protruding toward each other. The flange portions 67 are located higher than the upper end of the crank webs 8B when the piston 23 is positioned at the top dead center, so that the flange portions 67 do not interfere with the crankshaft 8. Further, the pair of flange portions 67 is arranged so that a predetermined gap is defined between the tip ends of the flange portions 67 in the left and right direction, whereby they do not interfere with the connecting rod 26.

As shown in FIG. 1, at portions of the front side wall 2D and the rear side wall 2E of the crankcase 2 located higher than the flange portions 67, two fuel injection valves 68 (68A, 68B) are respectively mounted. As also shown in FIG. 3, a tip end of each fuel injection valve 68 faces the upstream portion 57A of the corresponding scavenging port 55. Each fuel injection valve 68 is inclined relative to the radial direction of the cylinder axis A so as to be directed to the scavenging orifice 56 forming the downstream end of the corresponding scavenging port 55 and also faces in an obliquely upward direction. Each fuel injection valve 68 is drive-controlled by a control unit 70 so as to inject fuel toward the associated scavenging orifice 56 at a predetermined timing. Hereinafter, the fuel injection valve 68 mounted to the front side wall 2D will be referred to as a first fuel injection valve 68A, and the fuel injection valve 68 mounted to the rear side wall 2E will be referred to as a second fuel injection valve 68B.

Figure 4:
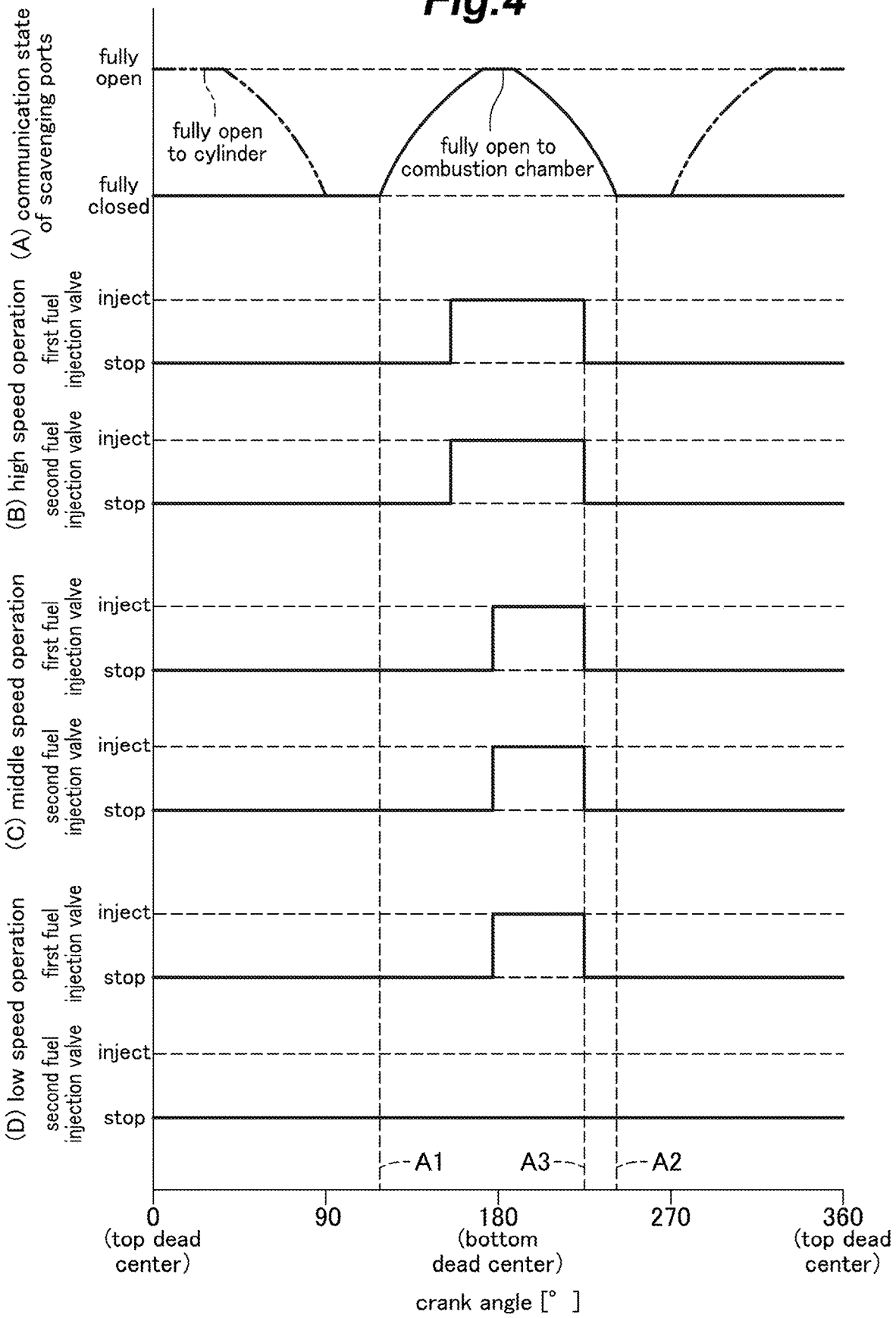
FIG. 4 is a graph showing a communication state of scavenging ports and drive states of fuel injection valves in one cycle.

FIG. 4 is a graph showing a communication state of the scavenging ports 55 and drive states of the fuel injection valves 68 in one cycle. The horizontal axis of the graph represents the crank angle. (A) of FIG. 4 shows the communication state of the scavenging ports 55, (B) of FIG. 4 shows the drive states of the fuel injection valves 68 when the engine E is in a high load operation, (C) of FIG. 4 shows the drive states of the fuel injection valves 68 when the engine E is in a middle load operation, and (D) of FIG. 4 shows the drive states of the fuel injection valves 68 when the engine E is in a low load operation. It is to be noted that in (A), solid lines of the communication state of the scavenging ports 55 indicate a state of the scavenging ports 55 in communication with the combustion chamber 29 or a part of the cylinder 22 above the piston 23, and imaginary lines indicate a state of the scavenging ports 55 in communication with a part of the cylinder 22 lower than the piston 23 (or a part the cylinder 22 connected with the crank chamber 2A). Because the scavenging orifices 56 have a predetermined height, it requires a predetermined crank angle for the communication state changes from fully closed to fully open and from fully open to fully closed. In the following description, the state in which the scavenging ports 55 are in communication with the part of the cylinder 22 lower than the piston 23 will be simply referred to as being in communication with the cylinder 22, and the state in which the scavenging ports 55 are in communication with the combustion chamber 29 or the part of the cylinder 22 above the piston 23 will be referred to as being in communication with the combustion chamber 29.

As shown in (A) of FIG. 4, when the crank angle is 0 degrees, the scavenging ports 55 are in communication with the cylinder 22. When the crank angle increases from 0 degrees in the downward stroke of the piston 23, the scavenging ports 55 start being closed by the piston 23. At the crank angle (e.g., 90 degrees) where the lower edge of the piston 23 reaches the lower edge of the scavenging orifices 56, the scavenging ports 55 are fully closed by the piston 23. The piston 23 moves further downward, and when a first crank angle A1 (e.g., 120 degrees) where the upper edge thereof coincides with the upper edge of the scavenging orifices 56 is reached, the scavenging ports 55 come into communication with the combustion chamber 29, and the communication area thereof increases as the crank angle increases. Before the crank angle reaches 180 degrees, the upper edge of the piston 23 passes the lower edge of the scavenging orifices 56 so that the scavenging orifices 56 in the fully open state communicate with the combustion chamber 29.

In the upward stroke of the piston 23, the communication state changes in a reverse manner to that in the downward stroke, so that the communication state is left-right symmetrical about the crank angle of 180 degrees or the bottom dead center. Namely, first, the scavenging ports 55 communicating with the combustion chamber 29 start being closed by the upward-moving piston 23, and at a second crank angle A2 (e.g., 240 degrees) where the upper edge of the piston 23 coincides with the upper edge of the scavenging orifices 56, the scavenging ports 55 are fully closed by the piston 23. Thereafter, when the lower edge of the piston 23 passes the lower edge of the scavenging orifices 56, the scavenging ports 55 come into communication with the cylinder 22, and when the lower edge of the piston 23 reaches the upper edge of the scavenging orifices 56, the scavenging ports 55 in the fully open state communicate with the cylinder 22.

In a crank angle range from the first crank angle A1 to the second crank angle A2, in which the scavenging ports 55 are in communication with the combustion chamber 29, in order to discharge the combustion gas from the combustion chamber 29 to the exhaust port 31, scavenging is performed by causing gas to flow into the combustion chamber 29 from the scavenging ports 55.

As shown in (B) of FIG. 4, when the engine E is in the high load operation, the control unit 70 drives the first and second fuel injection valves 68A, 68B to open at the same timing such that fuel is injected primarily in a late part of the crank angle range from the first crank angle A1 to the second crank angle A2 in which scavenging is performed. Specifically, the control unit 70 computes an amount of fuel necessary for one cycle, and causes the fuel injection valves 68 to inject the computed amount of fuel such that the fuel injection is completed at a third crank angle A3 that is prior to (smaller than) the second crank angle A2. The fuel injection is started at a crank angle (timing) obtained by converting a time period required to inject the necessary amount of fuel computed by the control unit 70 into a crank angle in accordance with the engine rotation speed, and subtracting this crank angle from the third crank angle A3. Therefore, if the engine rotation speed is the same, the higher the engine load is, the smaller the crank angle at which the fuel injection is started becomes (the start timing of the fuel injection becomes earlier). The crank angle at which the fuel injection is started may be smaller than 180 degrees, which is the center of the aforementioned crank angle, but is greater than the first crank angle A1.

As shown in (C) of FIG. 4, when the engine E is in the middle load operation, the control unit 70 drives the first and second fuel injection valves 68A, 68B to open at the same timing. Specifically, the control unit 70 causes the fuel injection valves 68 to inject fuel in a late part of the crank angle range from the first crank angle A1 to the second crank angle A2, and terminates the fuel injection at the third crank angle A3.

The start of the fuel injection is delayed compared to the high load operation shown in (B) of FIG. 4 provided that the engine rotation speed is the same.

As shown in (D) of FIG. 4, when the engine E is in the low load operation, the control unit 70 drives the first fuel injection valve 68A to open while stopping the driving of the second fuel injection valve 68B such that fuel is not injected from the second fuel injection valve 68B. Specifically, the control unit 70 causes the first fuel injection valve 68A to inject fuel in a late part of the crank angle range from the first crank angle A1 to the second crank angle A2, and terminates the fuel injection at the third crank angle A3. The total amount of fuel injection is smaller than in the middle load operation, but because the second fuel injection valve 68B is not driven to inject fuel, the start of the fuel injection becomes earlier compared to when the both fuel injection valves 68 are driven to inject fuel. On the other hand, compared to when the both fuel injection valves 68 are driven to inject fuel, the amount of injection by the first fuel injection valve 68A increases, and therefore, a ratio of error regarding the first fuel injection valve 68A becomes small, and an error amount becomes small.

The engine E having the structure described above operates as follows after start-up. With reference to FIG. 1, first, during the upward stroke of the piston 23, the pressure in the crank chamber 2A is lowered due to an expansion of the crank chamber 2A caused along with the upward movement of the piston 23. This causes the reed valves 54 to open, and fresh air flows into the crank chamber 2A via the intake ports 53. The air-fuel mixture in the upper part (the combustion chamber 29) of the cylinder 22 is compressed by the piston 23 such that the temperature thereof becomes high and the air-fuel mixture self-ignites (compression ignition) when the piston 23 is near the top dead center. It is to be noted that at the start-up of the engine E, fuel is combusted by spark ignition by the spark plug 30.

Thereafter, when the piston 23 starts its downward stroke, the pressure in the crank chamber 2A increases due to a contraction of the crank chamber 2A caused along with the downward movement of the piston 23. This causes the reed valves 54 to close, whereby the fresh air in the crank chamber 2A is compressed. As the piston 23 moves downward, the exhaust valve 32 driven by the valve actuating mechanism 34 opens the exhaust port 31. Thereby, the expanded exhaust gas (combustion gas) in the combustion chamber 29 flows to the exhaust port 31 as a blowdown flow. Subsequently, when the upper end edge of the piston 23 comes lower than the upper edge of the scavenging orifices 56 (namely, when the piston 23 opens the scavenging ports 55), the combustion chamber 29 is brought into communication with the scavenging ports 55. At this time, due to the flowing of the combustion gas in the combustion chamber 29 to the exhaust port 31, the pressure in the combustion chamber 29 has been lowered sufficiently to become lower than the pressure in the crank chamber 2A. Therefore, the fresh air in the crank chamber 2A flows into the combustion chamber 29 through the scavenging ports 55. Thereby, the combustion gas in the combustion chamber 29 is discharged through the exhaust port 31 by being pushed out by the fresh air entering the combustion chamber 29. Thereafter, fuel is injected from the fuel injection valves 68 toward the scavenging ports 55, and the generated air-fuel mixture flows into the combustion chamber 29. At this time, the air-fuel mixture forms a layer under the layer of fresh air that has entered the combustion chamber 29 earlier.

When the piston 23 starts the upward stroke again, the fuel injection valves 68 stop fuel injection before the scavenging ports 55 are closed by the piston 23. As the piston 23 moves further upward after the scavenging ports 55 are closed by the piston 23, the exhaust valve 32 driven by the cam 47 closes the exhaust port 31. Since the layer of air-fuel mixture is formed under the layer of fresh air in the combustion chamber 29, blow-by of the air-fuel mixture through the exhaust port 31 before the exhaust valve 32 closes the exhaust port 31 is suppressed. Thereafter, as the piston 23 moves upward, the air-fuel mixture in the combustion chamber 29 is compressed. At the same time, the pressure in the crank chamber 2A is lowered, and fresh air is taken in through the reed valve 54. The compressed air-fuel mixture self-ignites at a predetermined timing at which the piston 23 is near the top dead center.

In this way, the engine E performs a two-cycle operation. The flow of scavenging gas and exhaust gas from the scavenging ports 55 to the exhaust port 31 via the cylinder 22 is realized as a uni-flow guided along a relatively straight path.

In the following, effects of the engine E according to the present embodiment will be described. The engine E is provided with multiple fuel injection valves 68 for injecting fuel into the scavenging ports 55. Because the fuel injection valves 68 inject fuel into the scavenging ports 55, there is no need to apply a high pressure injection system to the fuel injection valves 68. In addition, because the start of fuel injection by the fuel injection valves 68 is delayed from the first crank angle A1 at which the scavenging ports 55 are opened, fresh air is sent into the cylinder 22 at an early stage of scavenging, and air-fuel mixture is sent into the cylinder 22 at a late stage of scavenging. Thereby, even when the engine E is a long-stroke engine, stratified scavenging is performed, and blow-by of air-fuel mixture is suppressed. On the other hand, in the low pressure injection system, when the start of fuel injection is delayed from the first crank angle A1 at which the scavenging ports 55 are opened, a large or special injection valve that can inject a large amount of fuel per unit time may become necessary to complete the fuel injection in a short time. However, in the engine E of the present embodiment, because the multiple fuel injection valves 68 are provided, it is possible to inject a predetermined amount of fuel in a short time by using compact, general-purpose and low-cost fuel injection valves 68.

As shown in FIG. 3, in the present embodiment, the multiple fuel injection valves 68 are provided so as to inject fuel toward the scavenging orifices 56, which are the openings of the scavenging ports 55 on the side of the cylinder 22. Thereby, the period of time from when the fuel is injected by the fuel injection valves 68 to when the fuel flows into the combustion chamber 29 is reduced, so that an appropriate amount of fuel is supplied to the combustion chamber 29 at an appropriate timing. This improves the stratified scavenging effect.

The fuel injection by the fuel injection valves 68 has a smaller ratio of error as the amount of injection increases and hence the injection period becomes longer. In relation to this, in the present embodiment, the control unit 70 for drive-controlling the multiple fuel injection valves 68 drives all of the fuel injection valves 68 in the middle and high load operations in which the amount fuel to be injected is relatively large, and stops driving at least one fuel injection valve 68 (the second fuel injection valve 68B) in the low load operation in which the amount of fuel to be injected is relatively small, as shown in FIG. 4. Therefore, in the low load operation where the amount of fuel injection is small, the amount of injection by the first fuel injection valve 68A that is driven is increased, whereby the ratio of error regarding the first fuel injection valve 68A becomes small and an error in the amount of fuel injection is reduced.

Further, the control unit 70 drive-controls the multiple fuel injection valves 68 such that the fuel injection is completed at the third crank angle A3, which is a timing earlier by a predetermined time determined in accordance with the rotation speed than the second crank angle A2 at which the scavenging ports 55 are closed by the piston. Thereby, adhesion of the injected fuel onto a side surface of the piston 23 and injection of fuel to a lower part of the cylinder 22 communicating with the crank chamber 2A due to passing of the piston 23 can be suppressed.

As shown in (B) and (C) of FIG. 4, the control unit 70 delays the start of the fuel injection by the multiple fuel injection valves 68 with a reduction in the load or a decrease in the amount of fuel to be injected. Thereby, the period in which the injected fuel flows into the combustion chamber 29 comes to be in a late stage of scavenging, and therefore, blow-by of air-fuel mixture is suppressed.

In the foregoing, the present invention has been described in terms of the preferred embodiment thereof, but as will be appreciated easily by a person having ordinary skill in the art, the present invention is not limited to such an embodiment and may be modified appropriately without departing from the spirit of the present invention. For example, in the above embodiment, two fuel injection valves 68 were provided such that the fuel injection valves 68 inject fuel into the two scavenging ports 55, respectively, but multiple fuel injection valves 68 may be provided for each scavenging port 55. Further, scavenging ports 55 larger in number than the fuel injection valves 68 may be formed.

Also, not all of the structure elements shown in the foregoing embodiments are necessarily indispensable, and they may be selectively used as appropriate without departing from the spirit of the present invention.

Glossary

2 crankcase
2A crank chamber
2G intake passage
3 cylinder block (cylinder wall)
4 cylinder head (cylinder wall)
19 cylinder sleeve (cylinder wall)
22 cylinder
23 piston
29 combustion chamber
31 exhaust port
32 exhaust valve
54 reed valve (one-way valve)
55 scavenging port
56 scavenging orifice (cylinder-side opening)
68 fuel injection valve
70 control unit
E engine (two-stroke engine)

The invention claimed is:

1. A two-stroke engine, comprising:
a cylinder wall defining a cylinder;
a piston reciprocably provided in the cylinder and defining a combustion chamber in the cylinder;
a crankcase defining a crank chamber communicating with a lower end of the cylinder;
an intake passage communicating with the crank chamber;
a one-way valve for opening and closing the intake passage;
a scavenging port communicating with the crank chamber and a side portion of the cylinder, and switchably brought into communication with or shut off from the cylinder by the piston;
an exhaust port communicating with a top part of the combustion chamber;
an exhaust valve for opening and closing the exhaust port;
multiple fuel injection valves for injecting fuel into the scavenging port; and
a control unit configured to drive-control the multiple fuel injection valves so as to start fuel injection at a timing later than a timing at which the scavenging port is opened by the piston, and terminate the fuel injection before the scavenging port is closed by the piston,
wherein the control unit is configured to delay a start of the fuel injection with a decrease in an amount of fuel to be injected.

2. The two-stroke engine according to claim 1, wherein the fuel injection valves are provided to be inclined relative to a cylinder axis and a radial direction of the cylinder axis so as to inject fuel toward an opening of the scavenging port on a side of the cylinder.

3. The two-stroke engine according to claim 1, wherein the control unit is configured to drive all of the fuel injection valves in middle and high load operations, and stop driving at least one fuel injection valve in a low load operation.

4. The two-stroke engine according to claim 1, wherein the control unit is configured to drive-control the fuel injection valves such that fuel injection is completed at a timing earlier by a prescribed time than a timing at which the scavenging port is dosed by the piston.

5. A two-stroke engine, comprising:

a cylinder wall defining a cylinder;

a piston reciprocably provided in the cylinder and defining a combustion chamber in the cylinder;

a crankcase defining a crank chamber communicating with a lower end of the cylinder;

an intake passage communicating with the crank chamber;

a one-way valve for opening and closing the intake passage;

a scavenging port communicating with the crank chamber and a side portion of the cylinder, and switchably brought into communication with or shut off from the cylinder by the piston;

an exhaust port communicating with a top part of the combustion chamber;

an exhaust valve for opening and dosing the exhaust port;

multiple fuel injection valves for injecting fuel into the scavenging port; and a control unit configured to drive-control the multiple fuel injection valves so as to start fuel injection at a timing later than a timing at which the scavenging port is opened by the piston and before the piston starts an upward stroke, and terminate the fuel injection before the scavenging port is dosed by the piston.

6. The two-stroke engine according to claim 5, wherein the fuel injection valves are provided to be inclined relative to a cylinder axis and a radial direction of the cylinder axis so as to inject fuel toward an opening of the scavenging port on a side of the cylinder.

7. The two-stroke engine according to claim 5, wherein the control unit is configured to drive all of the fuel injection valves in middle and high load operations, and stop driving at least one fuel injection valve in a low load operation.

8. The two-stroke engine according to claim 5, wherein the control unit is configured to drive-control the fuel injection valves such that fuel injection is completed at a timing earlier by a prescribed time than a timing at which the scavenging port is closed by the piston.

9. The two-stroke engine according to claim 5, wherein the control unit is configured to delay a start of the fuel injection with a decrease in an amount of fuel to be injected.

* * * * *